US009441378B1

(12) United States Patent
Conklin

(10) Patent No.: US 9,441,378 B1
(45) Date of Patent: Sep. 13, 2016

(54) PEDESTAL PAVER AND SKYLIGHT WALKWAY

(71) Applicant: Wayne Conklin, Butler, NJ (US)

(72) Inventor: Wayne Conklin, Butler, NJ (US)

( * ) Notice: Subject to any disclaimer, the term of this patent is extended or adjusted under 35 U.S.C. 154(b) by 0 days.

(21) Appl. No.: 14/839,527

(22) Filed: Aug. 28, 2015

(51) Int. Cl.

| | |
|---|---|
| ***E04D 13/12*** | (2006.01) |
| ***E04D 13/03*** | (2006.01) |
| ***E04B 7/18*** | (2006.01) |
| *E04D 13/035* | (2006.01) |

(52) U.S. Cl.
CPC ..... *E04D 13/0315* (2013.01); *E04B 7/18* (2013.01); *E04D 13/12* (2013.01); *E04D 13/035* (2013.01); *E04D 13/0305* (2013.01); *E04D 13/0335* (2013.01); *E04D 13/0354* (2013.01)

(58) Field of Classification Search
CPC ..... E04D 13/12; E04D 13/0315; E04D 13/0335; E04D 13/035; E04D 13/0354; E04D 13/0305; E04B 7/18
USPC ..... 52/200, 263
See application file for complete search history.

(56) References Cited

U.S. PATENT DOCUMENTS

| | | | | |
|---|---|---|---|---|
| 2,193,393 A | | 3/1940 | Danner | |
| 2,618,819 A | | 11/1952 | Goodwillie | |
| 3,065,506 A | * | 11/1962 | Tremer | E04F 15/02458 404/43 |
| 3,279,134 A | * | 10/1966 | Donovan | E04F 15/02405 52/126.6 |
| 3,811,237 A | * | 5/1974 | Bettinger | E04F 15/02452 52/126.6 |
| 4,074,480 A | | 2/1978 | Burton | |
| 4,193,237 A | * | 3/1980 | Jankowski | E04D 13/0315 52/19 |
| 4,222,213 A | | 9/1980 | Kessler | |
| 4,294,649 A | | 10/1981 | Sarka | |
| 4,431,691 A | | 2/1984 | Greenlee | |
| 4,479,988 A | | 10/1984 | Dawson | |
| 4,520,602 A | | 6/1985 | Miller | |
| 4,546,580 A | * | 10/1985 | Ueno | E04D 11/005 52/126.1 |
| 4,823,525 A | * | 4/1989 | Roberts | E04D 13/0305 52/200 |
| 4,994,309 A | | 2/1991 | Reichert et al. | |
| 4,999,964 A | | 3/1991 | Taylor | |
| 5,003,744 A | | 4/1991 | Taylor | |
| 5,042,210 A | | 8/1991 | Taylor | |
| 5,087,489 A | | 2/1992 | Lingemann | |
| 5,088,258 A | | 2/1992 | Schield et al. | |
| 5,207,036 A | | 5/1993 | Sampson et al. | |
| 5,218,806 A | | 6/1993 | Taylor | |
| 5,424,111 A | | 6/1995 | Farbstein | |
| 5,715,636 A | * | 2/1998 | Taylor | E04B 5/46 428/428 |
| 5,832,674 A | * | 11/1998 | Ledbetter | E04D 13/0315 181/224 |

(Continued)

FOREIGN PATENT DOCUMENTS

| | | |
|---|---|---|
| AU | B4022989 | 3/1990 |
| AU | B5464990 | 11/1990 |

(Continued)

*Primary Examiner* — Babajide Demuren
(74) *Attorney, Agent, or Firm* — Goldstein Law Offices, P.C.

(57) ABSTRACT

A skylight and paver walkway, installed to a roofing structure, including a skylight having a pane and framing members that surround and support the pane, and including a paving surface, the paving surface having plurality of pavers that extend immediately adjacent to the skylight. Each paver has a paver top, and is supported by a pedestal such that it is individually adjustable in height to make the pavers substantially level with each other. The framing members have a framing member top, and the panes have a pane top. The framing member top, the pane top, and paver top of the pavers adjacent to the framing member are substantially flush with each other, such that a continuous walkway is created between the skylight and paving surface.

18 Claims, 6 Drawing Sheets

(56) References Cited

U.S. PATENT DOCUMENTS

| | | | | |
|---|---|---|---|---|
| 8,191,317 | B2 * | 6/2012 | Lundsgaard | E04D 13/0354 49/349 |
| 8,225,561 | B2 | 7/2012 | Voegele, Jr. et al. | |
| 8,291,674 | B2 | 10/2012 | Valentz et al. | |
| 8,381,490 | B2 | 2/2013 | Back et al. | |
| 8,397,468 | B2 | 3/2013 | McClure | |
| 8,448,393 | B2 * | 5/2013 | Voegele, Jr. | E04D 13/0315 52/200 |
| 8,701,362 | B2 | 4/2014 | Stone | |
| 2006/0248814 | A1 * | 11/2006 | Chen | E04F 15/02476 52/126.6 |
| 2006/0272232 | A1 | 12/2006 | Fooks | |
| 2009/0110866 | A1 | 4/2009 | Ainz et al. | |
| 2009/0188189 | A1 * | 7/2009 | Repasky | E04D 11/007 52/291 |
| 2010/0005739 | A1 * | 1/2010 | Pendergast | E04F 15/02405 52/263 |
| 2011/0192941 | A1 * | 8/2011 | Lalancette | F16L 3/04 248/70 |
| 2014/0109499 | A1 | 4/2014 | Nieminen et al. | |

FOREIGN PATENT DOCUMENTS

| | | | | |
|---|---|---|---|---|
| CA | 2015714 | | 11/1990 | |
| CA | 1328970 | | 5/1994 | |
| DE | 9211240 | U1 * | 10/1992 | E04D 13/0305 |
| EP | 0356374 | | 2/1990 | |
| EP | 0396075 | | 11/1990 | |
| GR | 3017183 | | 11/1995 | |
| IE | 62450 | | 2/1995 | |
| IE | 67796 | | 5/1996 | |
| MX | 165468 | | 11/1992 | |
| MX | 172717 | | 1/1994 | |
| NZ | 230417 | | 3/1993 | |
| WO | WO2004042164 | | 5/2004 | |
| WO | WO2005019561 | | 3/2005 | |
| WO | WO2007011561 | | 1/2007 | |
| WO | WO2009056186 | | 5/2009 | |
| WO | WO2012041325 | | 4/2012 | |
| WO | WO2014066385 | | 5/2014 | |

* cited by examiner

PEDESTAL PAVER AND SKYLIGHT WALKWAY

TECHNICAL FIELD

The present disclosure relates generally to a pedestal paver and skylight walkway. More particularly, the present disclosure relates to a system for constructing a rooftop structure that includes a skylight and adjacent paving surface that provides a continuous, walkable surface.

BACKGROUND

Modern trends in building design often desire making rooftop surfaces into useable and even public spaces. Since skylights are often already specified for an intended building design, once the roof becomes a walkway, the skylight must be made "walkable". Making a walkable skylight means designing them to support the additional loading potential of numerous people walking and standing upon them. At a minimum, making a skylight walkable means that several layers of thick glass will be used.

Traditionally skylights provide additional illumination through standard roofing structures and are only designed to support their own weight and expected additional loading from snow. Generally they were not intended, and thus not designed, to support the weight of one or more persons walking upon them.

Further complicating the design of a walkable skylight, over the past several decades, nearly all new windows in residential and commercial buildings have more than one pane of glass and some type of thermally insulative structure or insulating glass unit (IGU). Typically they involve panes of glass separated by a thermal break spacer and sometimes involve evacuating the space in between or filling it with a noble gas such as argon or krypton. As these structures are typically not load-bearing, the materials used to fabricate such structures are generally lightweight and can be produced off-site in a manufacturing facility. In particular, the spacer typically employed consists of a tubular structure, made of thin metal, and often containing a desiccant material for absorbing moisture present in the air between the glass panels.

Unfortunately, multiple panels of thick heavy glass, and the weight of people walking thereupon, can be too much for the flimsy spacers currently available. It is inevitable that they will ultimately fail. Thus, because of the limitations in the glass spacers currently available, while architects desire the aesthetics and functionality of walkable skylight units, such aspirations must compete with the goal of creating an energy efficient building.

In addition, providing walkable surfaces on a rooftop must also consider other rooftop design constraints, such as providing adequate drainage. Accordingly, good drainage, usually indicates providing sloped surfaces. Walking surfaces, on the other hand, should be flat.

Pedestal pavers provide an option by allowing an underlying roof surface to be flat, while paving stones (or "pavers") provide a flat walking surface. This is accomplished by a network of pedestals that each support a paving stone. The pedestals are individually adjustable in height to accommodate a sloping roof surface while keeping the paving stones level with each other.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a system that provides a walkable rooftop surface that includes a substantially flat paver surface and a walkable skylight in a continuous walking surface. Accordingly, the system provides a skylight configuration that is load bearing and interfaces directly with a pedestal paver system such that the paver stones, skylight framing, and skylight panes are flush with each other.

It is another aspect of an example embodiment in the present disclosure to provide a system wherein each skylight pane is an insulating glass unit (IGU) that can withstand foot traffic and other loading considerations inherent in a walkable surface. Accordingly, the skylight in the present disclosure may provide a framing system that supports heavy duty, load-bearing structural glass panels and provides separate support for one or more thermal panels adjacent to the load bearing glass.

It is yet another aspect of an example embodiment in the present disclosure that the skylight framing provides heat and water insulating properties. Accordingly, the outer framing includes a resin filled thermal break, and the system employs glass setting blocks configured to work in conjunction with the framing, the structural glass, and thermal panels.

It is yet a further aspect of an example embodiment in the present disclosure to keep the skylight framing and panes flush by adjusting to variations in thicknesses of the structural glass panels. Accordingly, the framing system may employ an adjustable cap that provides sufficient variation in upper height of the framing members for easy adjustment at the time of installation.

It is an even further aspect of an example embodiment, in the present disclosure, to provide effective water handling and drainage for the whole system. Accordingly, waterproofing components are integrated continuously among the skylight framing, pedestal paver structures, and roofing structure.

Accordingly, the present disclosure describes a skylight and paver walkway, installed to a roofing structure, including a skylight having a pane and framing members that surround and support the pane, and including a paving surface, the paving surface having plurality of pavers that extend immediately adjacent to the skylight. Each paver has a paver top, and is supported by a pedestal such that it is individually adjustable in height to make the pavers substantially level with each other. The framing members have a framing member top, and the panes have a pane top. The framing member top, the pane top, and paver top of the pavers adjacent to the framing member are substantially flush with each other, such that a continuous walkway is created between the skylight and paving surface.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
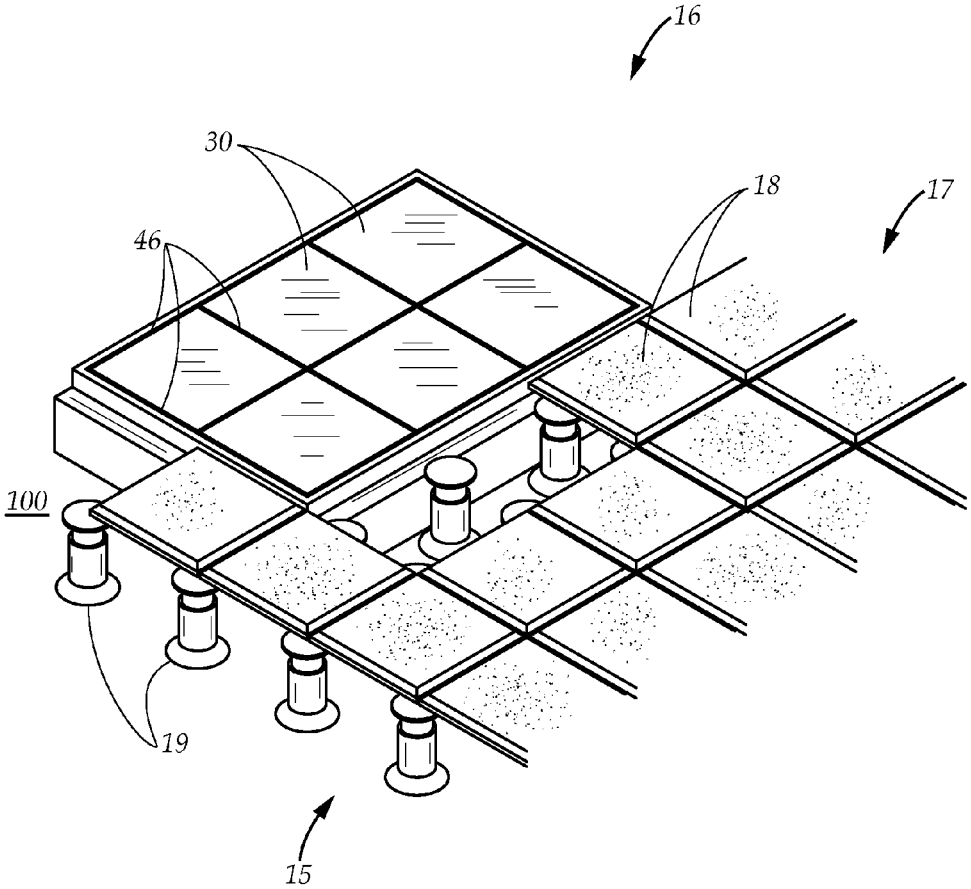
FIG. 1 is diagrammatic perspective view, illustrating a pedestal paver and skylight walkway, wherein components have been removed to show internal details thereof.
Figure 2:
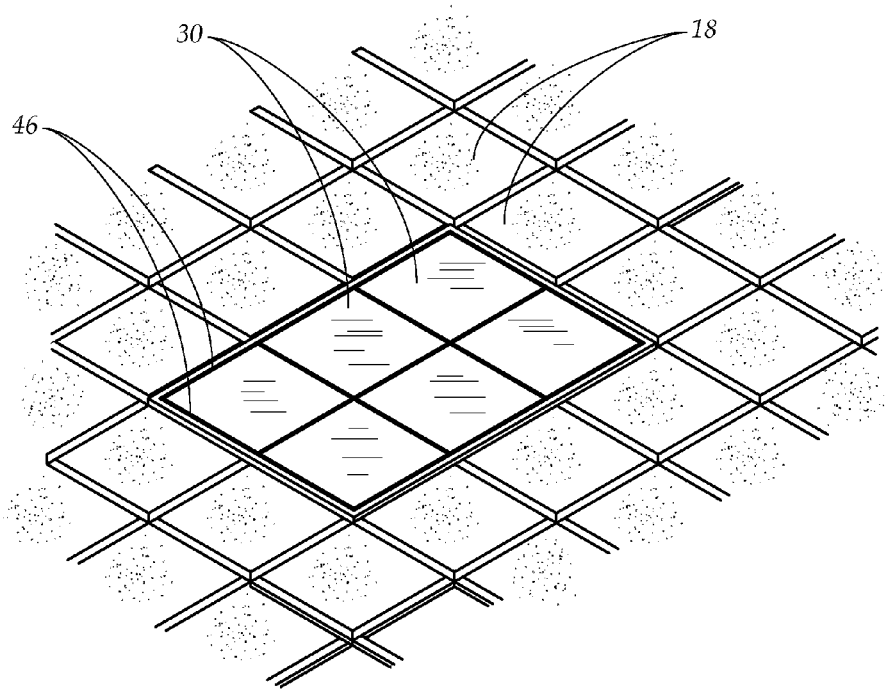
FIG. 2 is a diagrammatic perspective view, illustrating the skylight and pavers in a continuous walkway.

FIG. 1 and FIG. 2 illustrate a skylight and paver walkway 15. The walkway 15 includes a skylight 16, having framing members 46 that support glass panes 30, and a paving surface 17 that includes a plurality of pavers 18. The pavers 18, framing members 46, and panes 30 are substantially flush, so that the walkway 15 is continuous. The skylight 16 is mounted within a roofing structure 100. Pedestals 19 support the individual pavers 18 and are adjustable in height to keep the pavers 18 level, despite a likely drainage slope in the roofing structure 100.

Figure 3:
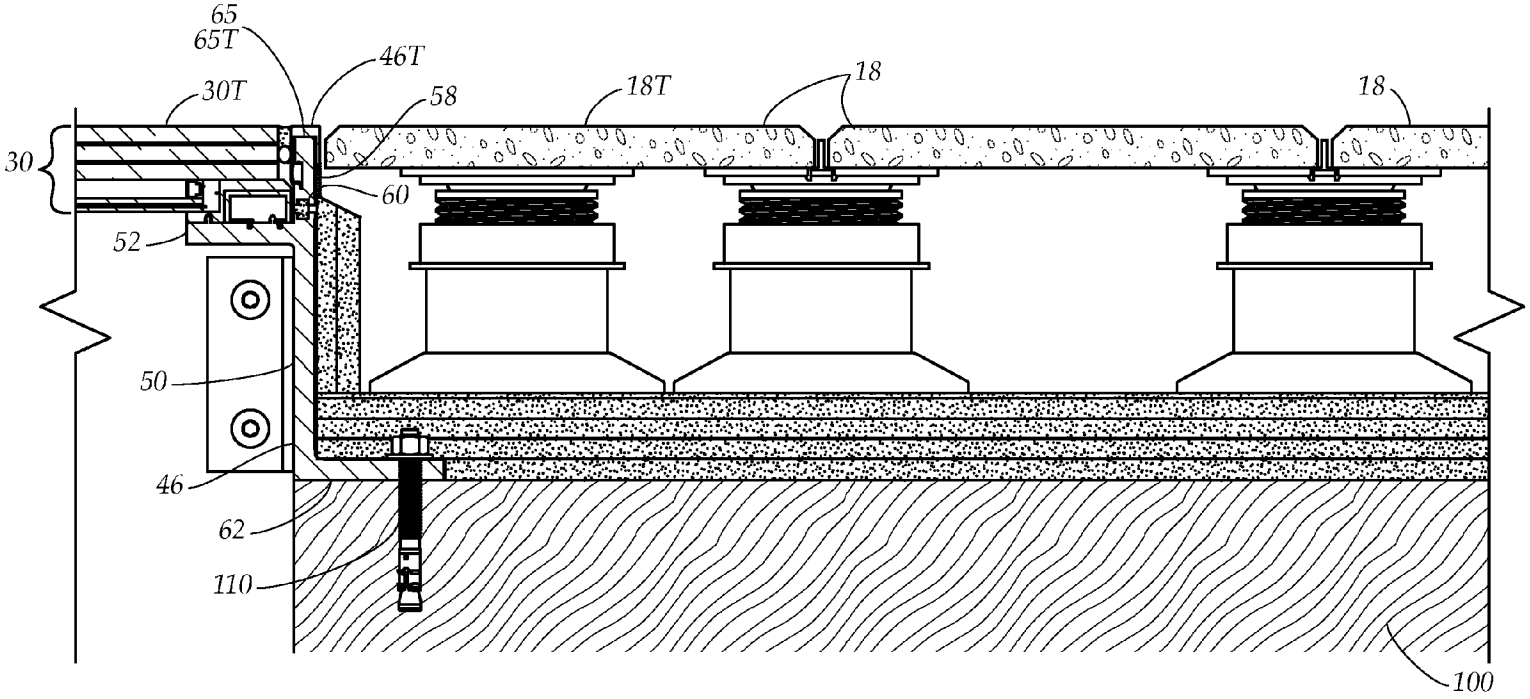
FIG. 3 is a cross sectional view, illustrating integration of the skylight, pavers, roof structure, and waterproofing materials to provide the continuous walkway.

FIG. 3 shows one of the framing members 46 of the skylight 16 secured to the roofing structure 100 with an anchoring fastener 110. In particular, the framing member has a vertical portion 50 and a connecting flange 62. The anchoring fastener 110 extends through the connecting flange 62. The framing member 46 has an upper vertical part 58 that is connected to the vertical portion 50 with a thermal break 60, and an adjustable cap 65 that fits onto the upper vertical part 58. The framing member 46 has a framing member top 46T. The framing member 46 has an adjustable cap 65 with an adjustable cap top 65T. In particular, the framing member top 46T may be defined as the adjustable cap top 65T. The framing member 46 also has a support shelf 52 that extends laterally from the vertical portion 50 and supports the pane 30.

The upper vertical part 58 that extends above the upper support shelf 52 is coextensive with the vertical portion 50. The thermal break 60 that connects the upper vertical part 58 and vertical portion 50 is made of an insulative material that connects and yet fully isolates the upper vertical part 58 from the vertical portion 50. The insulative material is preferably a resin that is inserted or injected as part of the extrusion process for fabricating the framing member 46. The framing member itself, including the vertical portion 50, the upper vertical part 58, and support shelf 52 is preferably made of a suitable structural material, a strong metal such as aluminum. The thermal break 60 is keyed, having a shape which includes portions that effectively lock within the upper vertical part 58 and vertical portion 50, to create a solid coextensive piece of material that comprises the framing member 46 once the resin hardens.

The pane 30 has a pane top 30T. Each paver 18 has a paver top 18T. In accordance with the principles of the present disclosure, the paver top 18T of at least the paver 18 adjacent to the framing member 52 is level and thus flush with the pane top 30T and with the framing member top 46T and thus the adjustable cap top 65T of the adjustable cap 65 between said pane 30 and said framing member 52.

Figure 4:
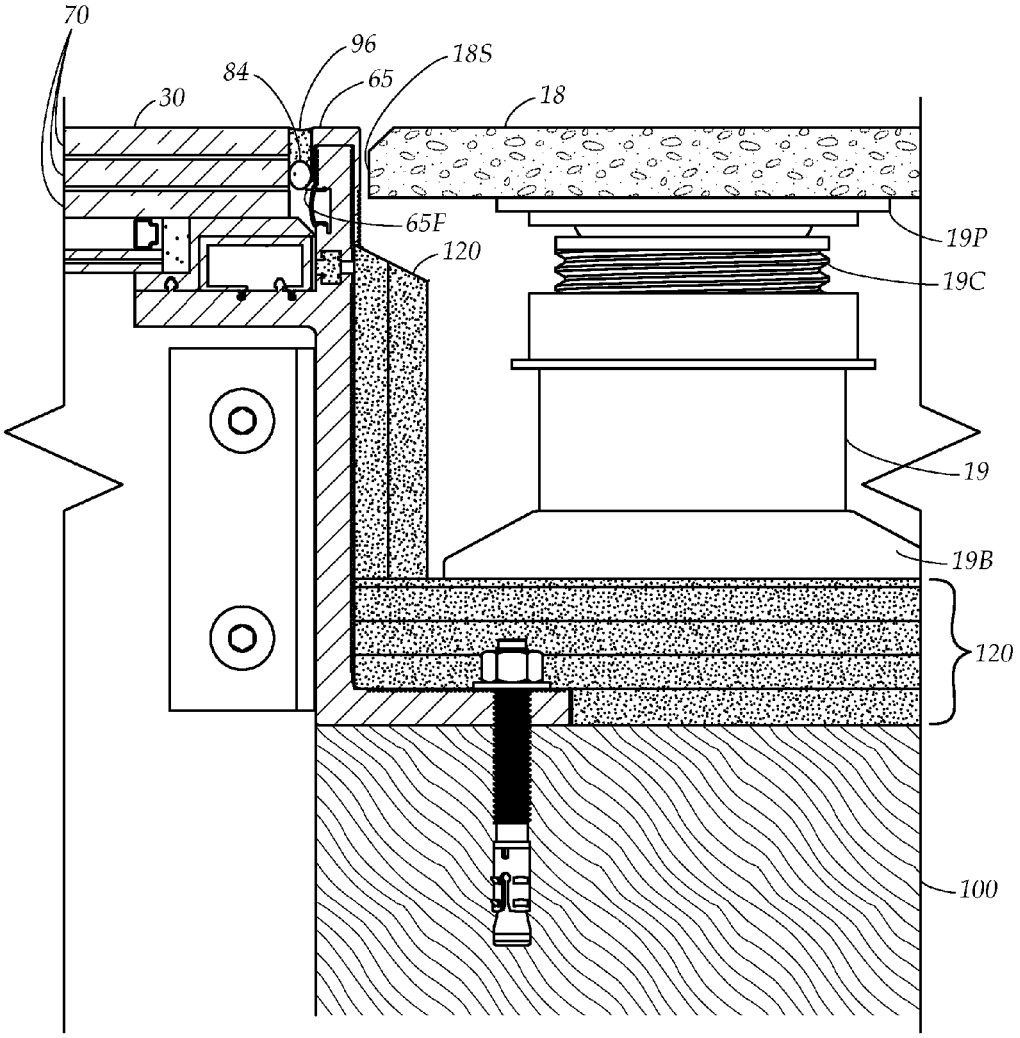
FIG. 4 is an enlarged cross sectional view, similar to FIG. 3.

Referring to FIG. 4, the pedestals 19 are supported on the roofing structure 100 upon waterproofing and insulation material 120 that extends along the roofing structure 100 and continues up along the framing member 46 to the adjustable cap 65. Each pedestal 19 has a base 19B, a platform 19P, and an adjustment mechanism 19C that adjusts relative distance between the base 19B and platform 19P and thereby provides height adjustment for the paver 18 supported by the platform 19P.

Figure 5:
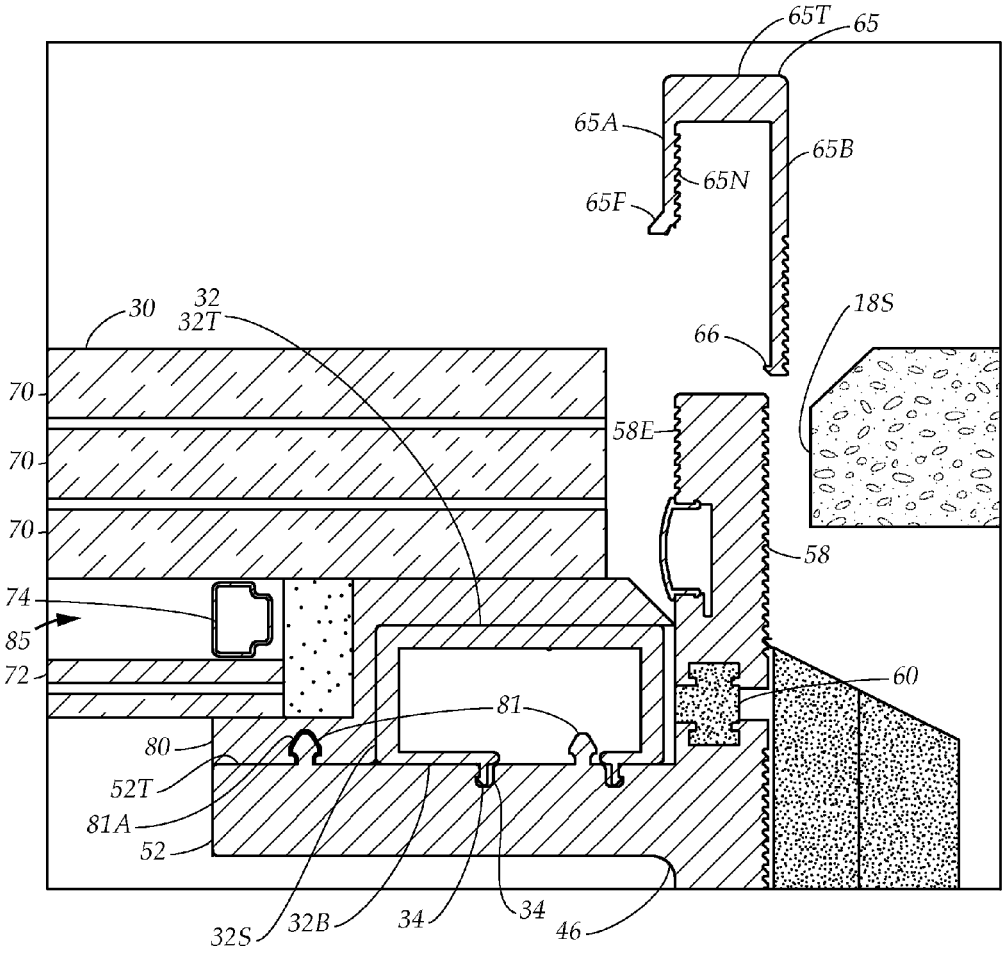
FIG. 5 is a cross sectional view, showing further details of the skylight framing system, wherein the adjustable cap has been separated from the upper vertical part.

Referring now to FIG. 5, details of the pane 30 are provided. Each pane includes several parallel panels of glass. In particular, the pane 30 is an insulating glass unit that includes structural glass panels 70, a thermal panel 72, and a spacer 74 that seals to the thermal panel 72 and structural glass panel 70 immediately thereabove and creates and seals an air gap 85 therebetween. The structural glass panels 70 have significant weight, often several hundred pounds each. The weight of the structural glass panels 70 could easily crush the spacer 74. To prevent the spacer 74 from crushing under the weight of the structural glass panels 70, separate support is provided for the structural glass panels 70 and thermal glass panel 72. In particular, a step block 32, having a bottom 32B and step block top 32T, rests upon the support shelf 52 and directly supports the heavy structural glass panels 70, while the thermal panel 72 and spacer 74 are supported more directly by the support shelf 52. The step block 32 has a step block height, and has a step block inner side 32S which creates its height. To properly support the structural panels 70 such that they do not exert their weight upon the spacer 74, the step block height is substantially the same as a thickness of the thermal panel 72 and vertical height of the spacer 74 combined. The step block 32 is made of metal, such as extruded aluminum, and may be configured to be detachable, wherein the step block bottom 32B and support shelf top 52T having mating fasteners 34 that allow the block 32 to selectively snap onto the support shelf 52.

The structural glass panels 70 and the thermal panel 72 rest upon a glass setting block 80. The glass setting block 80 is made of a rubbery, or rubber-like material, and acts as a gasket—cushioning the glass panels 70, 72 and sealing with the support shelf 52. The step block 32 creates a contour between the step block top 32T, the step block inner side 32S, and the support shelf 52. The glass setting block 80 follows this contour and extends between the structural glass panels 70 and step block top 32T, and between the thermal panel 72 and the support shelf 52. Optionally, the glass setting block 80 may also continue upwardly, along the upper vertical part 58. Preferably mating protrusions 81 and openings 81A on the framing member 46 and glass setting block 80 respectively, help maintain the glass setting block 80 in position. Note that one of the protrusions 81A shown is not illustrated as in use when the step block 32 is present. Both protrusions would be used when mating with a relatively flat glass setting block 80. A flat glass setting block 80 may be used when in place of the step block 32, a strong, load-bearing spacer is used to support the structural glass. Such load-bearing spacer has a solid, slab-like part that supports the weight of the structural glass, and an attached tube part similar to spacer 74, with the same thickness as the slab part that contains desiccant to remove moisture from the air gap 85.

In order for the framing member 46 to be height adjustable, the upper vertical part 58 has notched vertical edges 58E. The adjustable cap 65 is a substantially u-shaped channel having an inside wall 65A and an outside wall 65B, for extending inwardly of the framing member 46 and outwardly of the framing member 46, respectively. The adjustable cap top 65T extends betwee the inside wall 65A and outside wall 65B. The outside wall 65B has a lower hook 66 for engaging one of the notched vertical edges 58E, the inside wall 65A may have internal notches 65N for engaging the notched vertical edges 58E. The inside wall 65A also has a protruding foot 65F which extends downwardly and away from the inside wall 65A, toward the pane 30. Referring momentarily to FIG. 4, the protruding foot 65F provides support for backer rod 84, generally made of foam or the like, that is extended in the space beteween the adjustable cap 65 and pane 30. A sealant 96, such as clear structural silicone, is filled in above the backer rod, between the adjustable cap 65 and structural glass panels 70 that form part of the pane 30. Referring again to FIG. 5, the upper vertical part cap 65 is adapted to extend over the upper vertical part 58 and is pushed downardly thereupon until the adjustable cap top 65T is at its desired height.

With reference to FIGS. 3, 4, and 5, note that sice the pane 30 typically has four sides, it is supported on all four sides by apparatus described hereinabove, including the framing members 46, as well as the support shelf 52, step block 32, and glass setting block 80 provided for each framing member 46, such that four of each said items are arranged in a rectangular configuration to support the pane 30. Note, however, that in some installations having multiples panes 30, as seen in FIG. 1 and FIG. 2, each framing member does not have an upper vertical part 58, and the step block 32 may be wider, as each framing member 46 and each step block 32 is configured to support the structural glass panels from two adjacent panes, Similarly, in a single pane skylight, the pane 30 may be surrounded by four adjustable caps 65 that create a boundary for the pane 30 that is flush therewith, as described above. When multiple panes are present, only the panes 30 adjacent to the pavers 18 will have the adjustable cap 65. Panes 30 that adjoin other panes 30, however, will be flush with each other, with a small gap therebetween that is generally filled with silicone sealant.

Also seen in FIG. 5, each paver 18 has a side surface 18S. As seen in FIG. 4, there is a gap between the side surface 18S of the paver 18 nearest to the framing member 46, and the adjustable cap 65 on that framing member. This gap allows water to drain toward the roof support structure 100, where the waterproofing material and the drainage sloping will allow the water to drain away from the skylight 16. FIG. 3 illustrates how this gap is present between all the pavers 18, to allow water to drain beneath the pavers, where it is directed toward existing rooftop drainage fixtures.

Also in FIG. 5, the framing member 46 may also have an edge lighting assembly for providing edgewise illumination of the glass, that may include a lighting channel 102, a translucent lighting lens 104 that selectively covers and extends into the lighting channel 102, and a lighting element extending within the lighting channel 102. Note that back paint may be provided between two uppermost of the structural glass panels, creating a border region near the framing member, to hide the glass setting block 80 and spacer 74 from view by a person walking upon the skylght 16.

Figure 6:
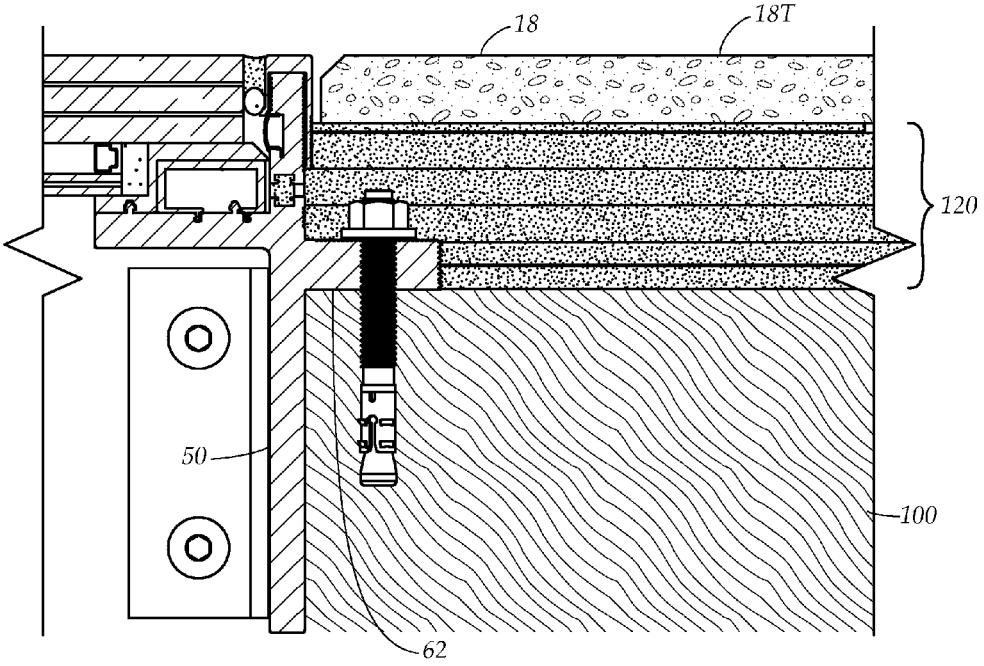
FIG. 6 is a cross sectional view, showing another embodiment of the system, the pavers supported upon the waterproofing and insulation materials, without pedestals.

FIG. 6 illustrates another embodiment of the skylight and paver walkway 15. Notably, the connecting flange 62 is much higher on the vertical portion 50, as the roofing structure 100 is much closer to the paver top 18T. In this embodiment, the pavers 18 are directly supported upon the roofing structure by the waterproofing and insulation material 120, with no pedestals present. In this embodiment, drainage can be accomplished by the roofing structure 100 itself sloping, or by manipulating the waterproofing and insulation material 120 to create a gradual slope. Note that while the paver tops 18T of the pavers might gradually slope away from the skylight—especially those distant from the skylight 16—the paver top 18T of the paver 18 adjacent to the skylight 16 can still be substantially level with pane 30, and still maintain the continuous walkway with the skylight in accordance with the principles of the present disclosure.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a paver and skylight walkway, configured to provide a continuous walking surface. The disclosure is illustrated by example in the drawing figures and throughout the written description. It should be understood that numerous variations are possible while adhering to the inventive concept. Such variations are contemplated as being a part of the present disclosure.

What is claimed is:

1. A paver and skylight walkway, installed upon a roofing surface, comprising:

a skylight, having framing members that support a glass pane, the pane having a pane top, the framing members each having an adjustable cap that is height adjustable, each adjustable cap having an adjustable cap top;

a paving surface having a plurality of pavers supported by and raised above the roofing structure, each paver having a paver top, the paving surface extending immediately adjacent to the skylight; and wherein the paver top of each paver that is immediately adjacent to one of the framing members is flush with the adjustable cap top of the adjustable cap of said framing member and flush with the glass pane such that a continuous walking surface is created with the skylight and paving surface.

2. The paver and skylight walkway as recited in claim 1, further comprising a pedestal associated with each paver, each pedestal having a base, a platform, and an adjustment mechanism, each pedestal supporting its associated paver on its platform.

3. The paver and skylight walkway as recited in claim 2, wherein four framing members together surround and support the pane, each framing member has a vertical portion, an upper vertical part, and a thermal break between the vertical portion and the upper vertical part.

4. The paver and skylight walkway as recited in claim 3, wherein the pane is an insulating glass unit that includes a structural glass panel having significant weight, a thermal glass panel, and a spacer between the structural glass panel and thermal glass panel creating an air gap therebetween.

5. The paver and skylight walkway as recited in claim 4, wherein each framing member includes a support shelf that has a support shelf top and extends laterally from the vertical portion, and a step block on the support shelf top, the step block having a step block top, a step block bottom, and a step block inner side, wherein the structural glass panel is supported by the step block and the thermal glass panel is supported by the support shelf, such that the structural glass panel does not exert its weight upon the spacer between the structural glass panel and thermal glass panel.

6. The paver and skylight walkway as recited in claim 5, further comprising a glass setting block associated with each framing member, each glass setting block made of a rubbery material and extending upon the support shelf for directly supporting the thermal pane, extending upwardly along the step block inner side, and extending across the step block top to directly support the structural glass panel.

7. The paver and skylight walkway as recited in claim 6, wherein the support shelf top and step block bottom have mating fasteners such that the step block is selectively detachable from the support shelf.

8. The paver and skylight walkway as recited in claim 7, wherein the adjustable cap includes an inside wall and an outside wall, the inside wall having a protruding foot that extends between the framing member and the pane, wherein the paver and skylight walkway further comprises backer rod extending between the pane and framing members, and wherein the protruding foot helps maintain the backer rod in place.

9. A paver and skylight walkway, installed upon a roofing surface, comprising:

a skylight, having framing members that are secured to the roofing surface and support a glass pane, each framing member having a framing member top, the pane having a pane top, wherein the pane is an insulating glass unit that includes a structural glass panel having weight, a thermal glass panel, and a spacer between the structural glass panel and thermal glass panel creating an air gap therebetween, wherein the structural glass panel and thermal panel are separately supported such that the structural glass panel does not exert its weight upon the spacer and thermal glass panel;

a paving surface having a plurality of pavers supported by and raised above the roofing structure, each paver having a paver top, the paving surface extending immediately adjacent to the skylight; and wherein the paver top of each paver that is immediately adjacent to one of the framing members is flush with framing member top of said framing member and flush with the glass pane such that a continuous walking surface is created with the skylight and paving surface.

10. The paver and skylight walkway as recited in claim 9, wherein each framing member has a vertical portion, an upper vertical part, and a thermal break that connects the vertical portion and upper vertical part, each framing member further having a support shelf having a support shelf top, and having a step block that is attached to the support shelf top and have a step block top, wherein the support shelf top supports the thermal glass panel and the step block top supports the structural glass panel.

11. The paver and skylight walkway as recited in claim 10, further comprising a glass setting block associated with each framing member, each glass setting block made of a rubbery material and extending upon the support shelf for directly supporting the thermal pane, extending upwardly along the step block inner side, and extending across the step block top to directly support the structural glass panel.

12. The paver and skylight walkway as recited in claim 11, wherein each framing member has an adjustable cap having an adjustable cap top, the adjustable cap top is the framing member top, wherein the adjustable cap includes an inside wall and an outside wall, the inside wall having a protruding foot that extends between the framing member and the pane, wherein the paver and skylight walkway further comprises backer rod extending between the pane and framing members, and wherein the protruding foot helps maintain the backer rod in place.

13. The paver and skylight walkway as recited in claim 12, further comprising a pedestal associated with each paver, each pedestal having a base, a platform, and an adjustment mechanism, each pedestal supporting its associated paver on its platform.

14. A paver and skylight walkway, installed upon a roofing surface, comprising:

a skylight, having framing members that are secured to the roofing surface and support a glass pane, each framing member having a framing member top, the pane having a pane top, wherein the pane is an insulating glass unit that includes a structural glass panel having significant weight, a thermal glass panel, and a spacer between the structural glass panel and thermal glass panel creating an air gap therebetween, wherein the structural glass panel and thermal panel are separately supported such that the structural glass panel does not exert its weight upon the spacer and thermal glass panel;

a paving surface having a plurality of pavers, and having a pedestal associated with each paver, each pedestal having a base, a platform, and an adjustment mechanism, each pedestal supporting its associated paver on its platform, each paver having a paver top, the paving surface extending immediately adjacent to the skylight; and wherein the paver top of each paver that is immediately adjacent to one of the framing members is flush with the framing member top of said framing member and flush with the glass pane such that a continuous walking surface is created with the skylight and paving surface.

15. The paver and skylight walkway as recited in claim 14, wherein each framing member has a vertical portion, an upper vertical part, and a thermal break that connects the vertical portion and upper vertical part, each framing member further has a support shelf having a support shelf top, and a step block that is attached to the support shelf top and has a step block top, wherein the support shelf top supports the thermal glass panel and the step block top supports the structural glass panel.

16. The paver and skylight walkway as recited in claim 15, wherein the framing members as recited include four framing members that together surround and support the pane, each framing member has a vertical portion, an upper vertical part, and a thermal break between the vertical portion and upper vertical part.

17. The paver and skylight walkway as recited in claim 16, further comprising a glass setting block associated with each framing member, each glass setting block made of a rubbery material and extending upon the support shelf for directly supporting the thermal glass panel, extending upwardly along the step block inner side, and extending across the step block top to directly support the structural glass panel.

18. The paver and skylight walkway as recited in claim 17, wherein each framing member has an adjustable cap having an adjustable cap top which is the framing member top, wherein the adjustable cap includes an inside wall and an outside wall, the inside wall having a protruding foot that extends between the framing member and the pane, wherein the paver and skylight walkway further comprises backer rod extending between the pane and framing members, and wherein the protruding foot helps maintain the backer rod in place.

* * * * *